US006089133A

United States Patent [19]

Liao

[11] Patent Number: 6,089,133

[45] Date of Patent: Jul. 18, 2000

[54] SCREWDRIVER

[76] Inventor: Youn Chyuan Liao, No 1-1, Lane 68, Fu Hsing North Rd., Taichung, Taiwan

[21] Appl. No.: 09/371,960

[22] Filed: Aug. 11, 1999

[51] Int. Cl.[7] ..... B25B 23/00

[52] U.S. Cl. ..... 81/438; 81/436; 81/177.2

[58] Field of Search ..... 81/436, 438, 439, 81/177.5, 73, 489

[56] References Cited

U.S. PATENT DOCUMENTS

| | | | |
|---|---|---|---|
| 2,592,978 | 4/1952 | Trimboli | 81/436 |
| 5,003,850 | 4/1991 | Harkins | 81/436 |
| 5,836,223 | 11/1998 | Lin | 81/436 |

FOREIGN PATENT DOCUMENTS

| | | | |
|---|---|---|---|
| 741638 | 12/1932 | France | 81/177.5 |

*Primary Examiner*—David A. Scherbel
*Assistant Examiner*—Hadi Shakeri

[57] ABSTRACT

The present invention is related to a screwdriver in which a shaft lever with polygon socket is inserted into the central hole of the screwdriver handgrip so that a turning shaft to facilitate force application is plugged from the rear end of the handgrip into the socket in order to perform a rapid rotation of the shaft lever; the other end of the shaft lever can be connected to a extension shaft to be in a coupled state while an application shaft for screwdriver head can be plugged into the inner hole of the extension shaft, and the screwdriver head is inserted into the socket of the application end of the application shaft to perform screwing, wherein the application shaft for screwdriver head can be designed to be section-type, and the application shaft can be stretched inside of the connection inner hole of the extension shaft and shaft lever by means of an engaging member fitted to the outer circumference of the extension shaft so that the exposing length is adjustable; in addition, a freely turning sleeve can be mounted between the handgrip and the extension shaft to be a holding supporting point in performing a rapid screwing.

3 Claims, 9 Drawing Sheets

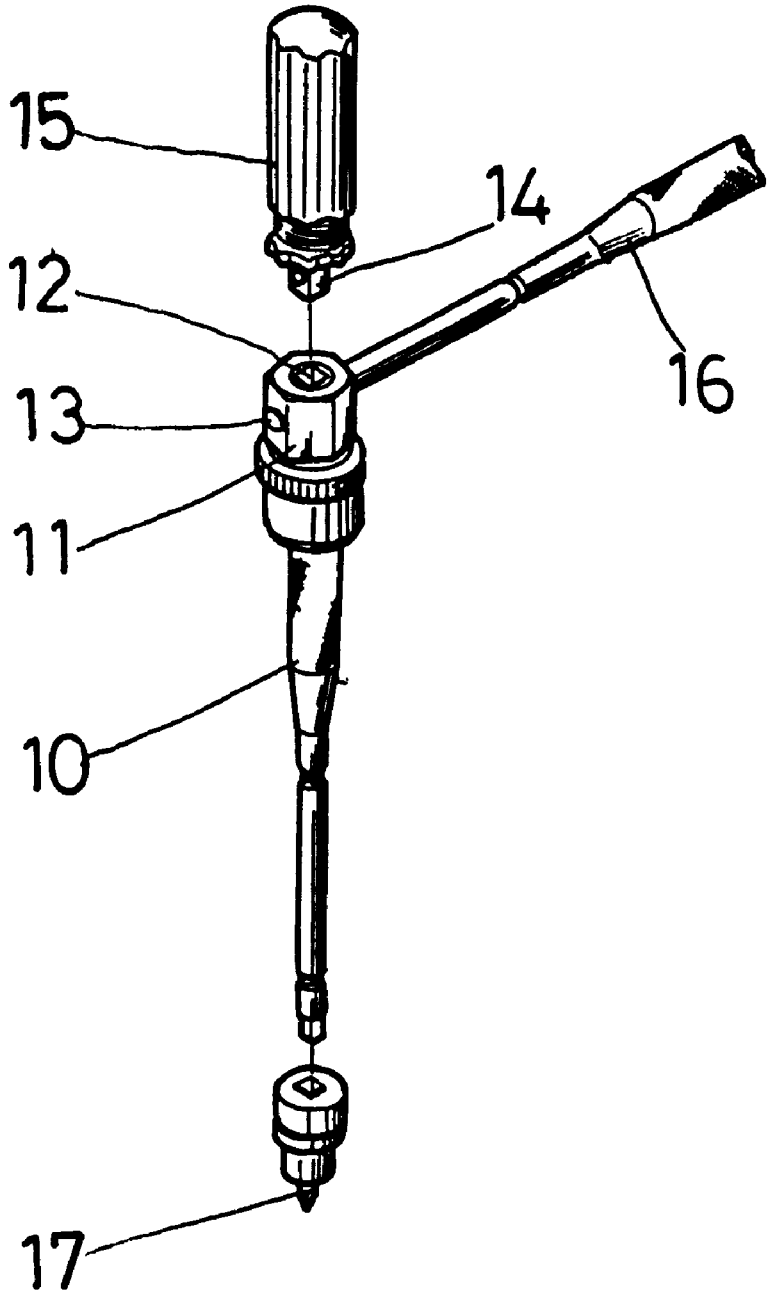
FIG.1-A
PRIOR ART

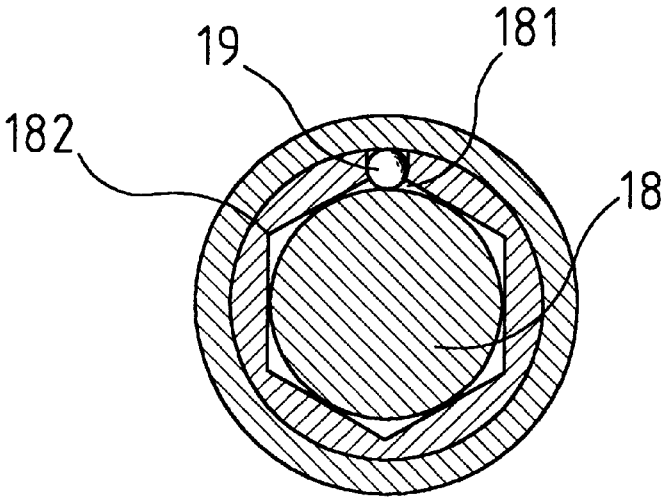
FIG.1 - B
PRIOR ART
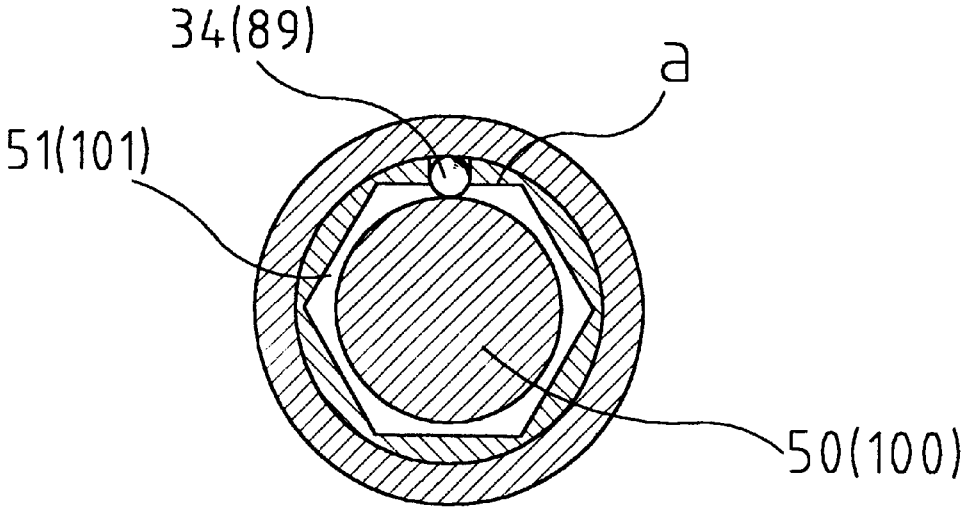
FIG.9

SCREWDRIVER

BACKGROUND OF THE INVENTION

1. Field of the Invention

The present invention relates to a screwdriver with a turning shaft for assisting force application and special application shaft for screwdriver head in order to save time, and energy in operation thereof and to achieve multiple using functions.

2. Description of the Prior Art

The assisting turning shaft of the conventional screwdriver is related to a shaft body which can be plugged into a handgrip to be in a vertical state while the torsion value of the screwdriver can be increased by means of the turning shaft in order to achieve the time- and energy-saving effect. As shown in FIG. 1-A, the conventional screwdriver is fitted with a polygon head end 11 at the top of the shaft-shaped main body 10 which includes a longitudinal square socket 12 and a lateral circular borehole at the certain position thereof. The longitudinal square socket 12 hat a handgrip 15 with a square plug shaft 14 which is plugged downward so that a normal screwdriver form is formed while the lateral circular borehole 13 serves for lateral inserting of an assisting turning shaft 16. The turning shaft 16 and the main body 10 are in a vertical state in order to obtain an added effect to increase the torsion value.

Although the conventional screwdriver can be used to enhance the torsion, the turning shaft 16 and the handgrip 15 can be applied together, that is, it's required to remove the handgrip 15 from the socket 12 of the head end 11 first when the turning shaft 16 is used so that the turning shaft 16 can be smoothly inserted into the borehole 13. Similarly, the turning shaft 16 should be removed before using the handgrip 15. This results in much inconvenience.

Furthermore, one hand should hold the main body 10 lightly while the other holds the turning shaft 16 to apply a single-direction force in using the turning shaft 16 of the conventional screwdriver. However, no accessories are fitted to the main body 10 or the turning shaft 16 so that the screwdriver head 17 of the application end of the main body 10 should be removed from the screw piece of work first in order to place the turning shaft 16 to the original force application position and then to place the screwdriver head 17 on the screw piece of work for applying force. Thus, this can't achieve the goal of rapid screwing.

SUMMARY OF THE INVENTION

It is the main object of the present invention to provide a screwdriver on which a freely turning sleeve is dispose between a shaft lever and a handgrip for the user to grip thereon without influence on the turning effect of the screwapplication shaft for screwdriver head so that it can be prevented that the main body is slid away or falls down; meanwhile, another turning sleeves can be pivoted on two bending ends of the turning shaft in order for users to hold either of them to apply force continuously without stopping working to adjust the force application position; therefore, a rapid and energy-saving screwing can be achieved.

It is another object of the present invention to provide a screwdriver which serves as a conventional screwdriver in an ordinary state without exchanging the turning shaft for an alternative use.

It is a further object of the present invention to provide a screwdriver whose application shaft for screwdriver head can be freely stretched in accordance with the desired screwing length in order to meet the special operation requirements (e.g. in screwing in a deep hole).

BRIEF DESCRIPTION OF THE DRAWINGS

The drawings disclose illustrative embodiments of the present invention which serves to exemplify the various advantages and objects hereof, and are as follows:

FIG. 1-A is an exploded perspective view of a conventional screwdriver;

FIG. 1-B is a schematic drawing of an engaging position of the screwdriver main body and the steel ball;

FIG. 9 is a schematic drawing of an engaging position of the screwdriver main body and the steel ball.

DETAILED DESCRIPTION OF THE PREFERRED EMBODIMENT

Figure 2:
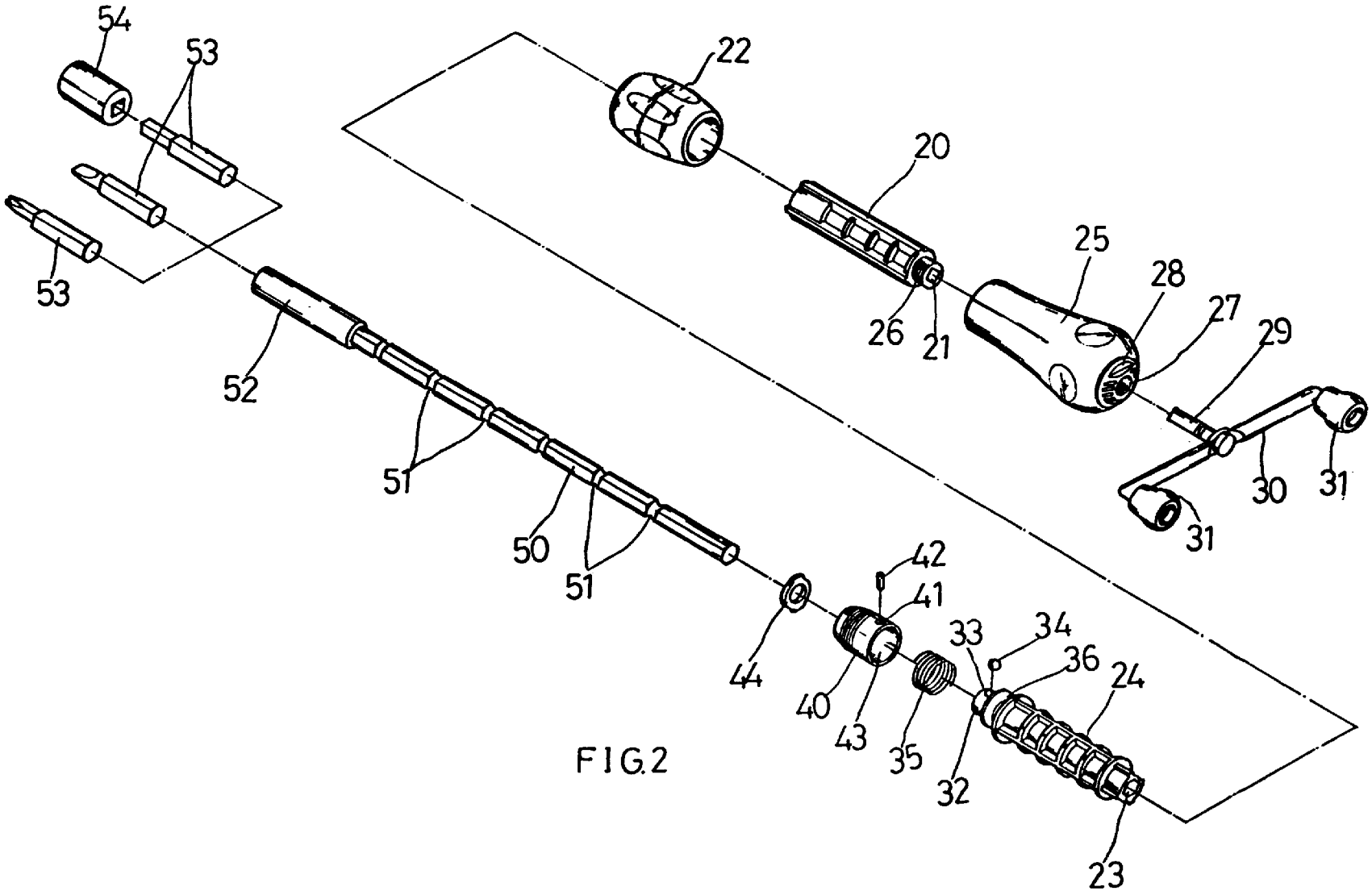
FIG. 2 is an exploded perspective view of a preferred embodiment of the present invention.
Figure 3:
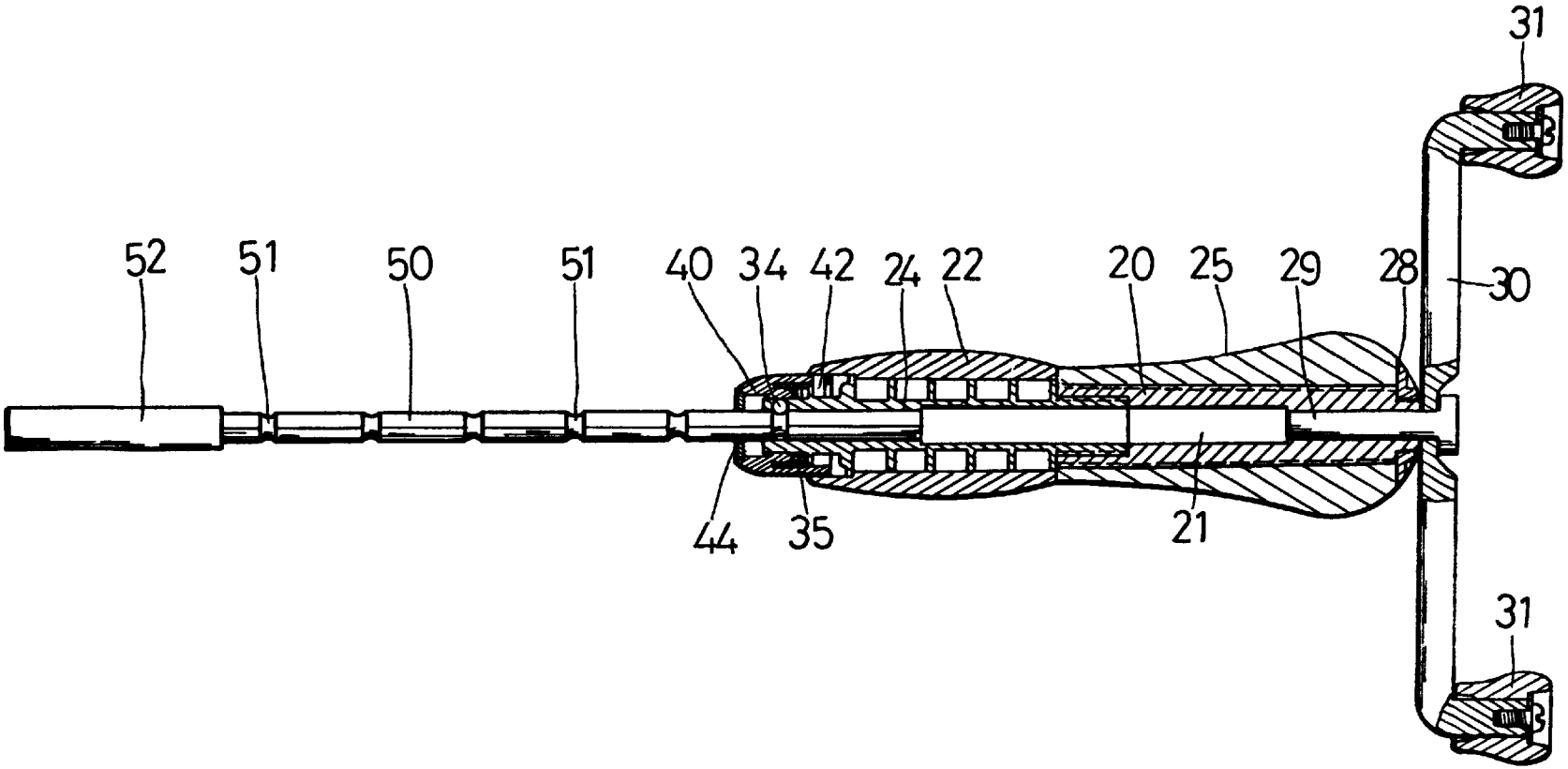
FIG. 3 is a sectional view in accordance with FIG. 2 after assembly.

First of all, referring to FIGS. 2 and 3, they show a preferred embodiment of the present invention. The screwdriver in accordance with the present invention includes a shaft lever 20 with an axial polygon socket 21 around which a turning sleeve 22 is mounted at one end thereof in which an extension shaft 24 with an inner hole 23 is so plugged that the socket 21 of the shaft lever 20 and the inner hole 23 of the extension shaft 24 are connected with each other. The other end of the shaft lever 20 is plugged into one end of a handgrip 25, and the shaft lever 20 is connected to the other end of the handgrip 25 by means that a male thread 26 at the end of the shaft lever 20 is screwed with a female thread 27 of a locating turning cover 28 at the other end thereof. An U-shaped turning shaft 30 with a plug shaft 29 to facilitate the force application can be plugged into the socket 21 of the shaft lever 20 at the end of the handgrip 25. Two bending ends of the U-shaped turning shaft 30 are pivoted with a turning sleeve 31 respectively. One end of the extension shaft 24 is fitted with an engaging member 40 to be connected with a section-type application shaft 50 so that the application shaft 50 can be stretched inside of the connecting inner hole of the extension shaft 24 and the shaft lever 20 and it exposing length is therefore adjustable.

The assembly of the engaging member 40 and the extension shaft 24 is performed in the way that a ball hole 33 for receiving an engaging steel ball 34 is disposed on a circular neck 32 at the opposite outer end of the extension shaft 24. Thereafter, a spring 35 and an engaging member 40 are placed on the circular neck 32 one after the other. The engaging member 40 has a pin hole 41 on the face thereof for receiving a pin 42 which is just engaged in the slotted rib 36 at the relative position of the outer circumference of the extension shaft 24. Therefore, the position of the turning sleeve 22 can just cover the position of the pin 42 of the engaging member 40 so that the engaging member 40 can be located in position.

Figure 4:
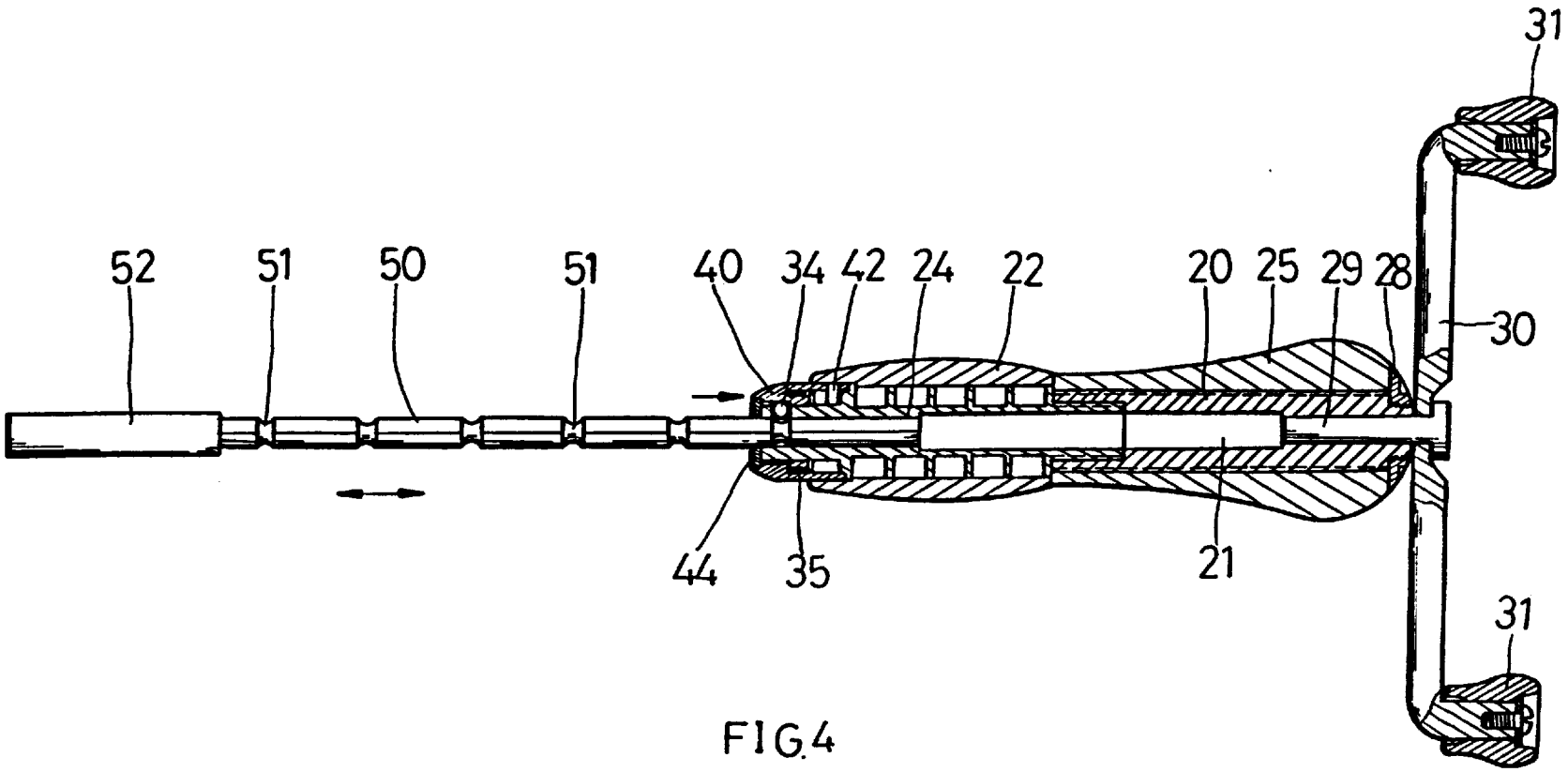
FIG. 4 is a sectional view in accordance with FIG. 2 after assembly, illustrating the operation direction.

In the ordinary state, as shown in FIG. 3, the steel ball 34 is engaged in an inner hole 43 of the engaging member 40, and the steel ball 34 can be engaged in any ring groove 51 of the application shaft 50 to locate the application shaft 50 in position. In adjusting the length of the application shaft 50, as shown in FIG. 4, it is only required to push the engaging member 40 in the direction of the handgrip 25 to remove the steel ball 34 from the engaging state. Thus, the length adjustment can be achieved.

As mentioned above, the turning sleeve 22 and the turning sleeves 31 are turnable, so that, when the user uses the U-shaped turning shaft 30 to make a rapid rotation, the turning sleeve 22 and the turning sleeves 31 can be used as holding supporting points.

In order to prevent unusual objects into the inner hole 43 of the engaging member 40, the open end of the engaging member 40 is fitted with a cover 44 to cover the inner hole 43 exactly.

Driver heads or sockets in various forms can be plugged into the application end 52 of the application shaft 50 to meet different requirements in operation. This is not the object of the present invention so that it won't be described here any more.

Figure 5:
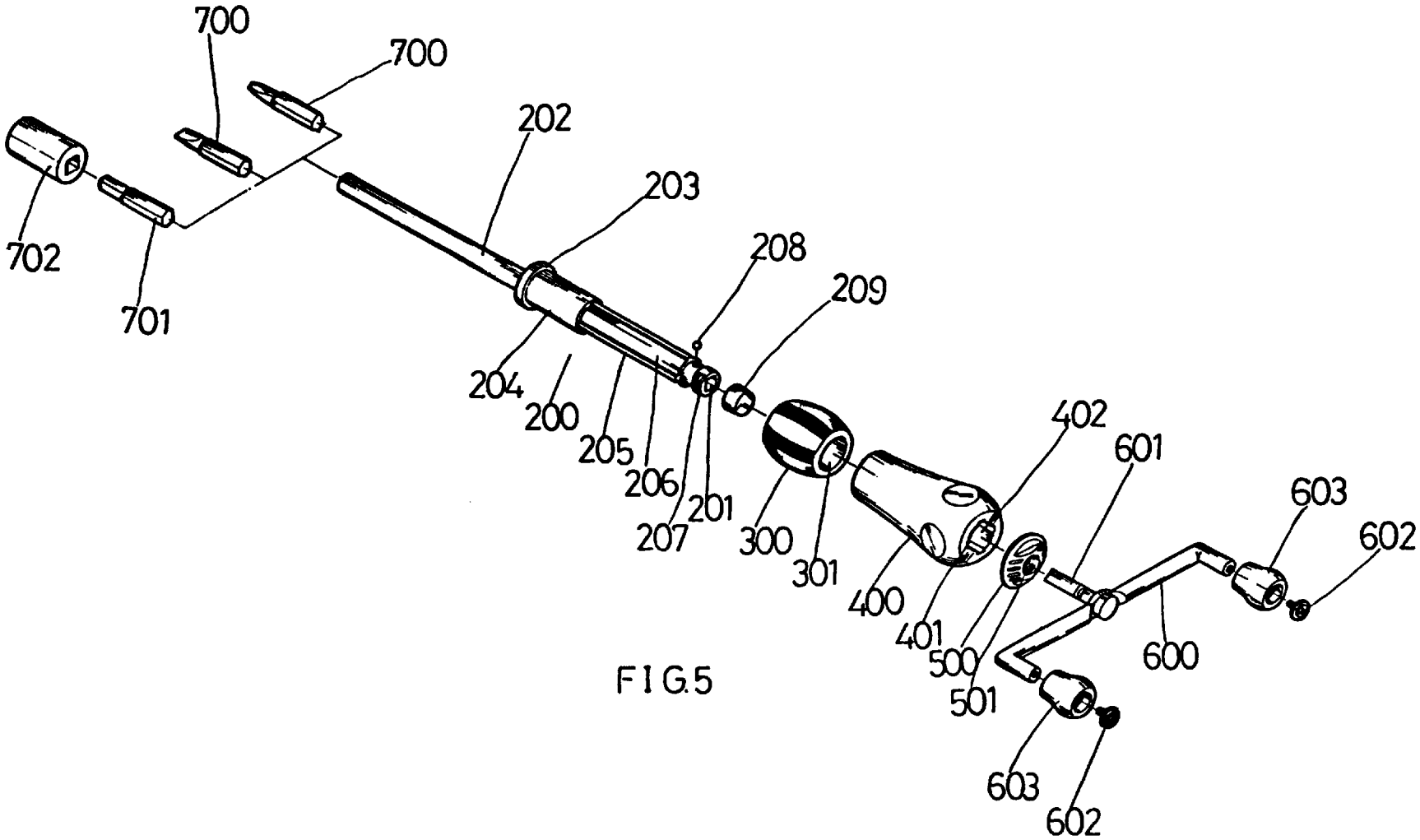
FIG. 5 is an exploded perspective view of another preferred embodiment of the present invention.
Figure 6:
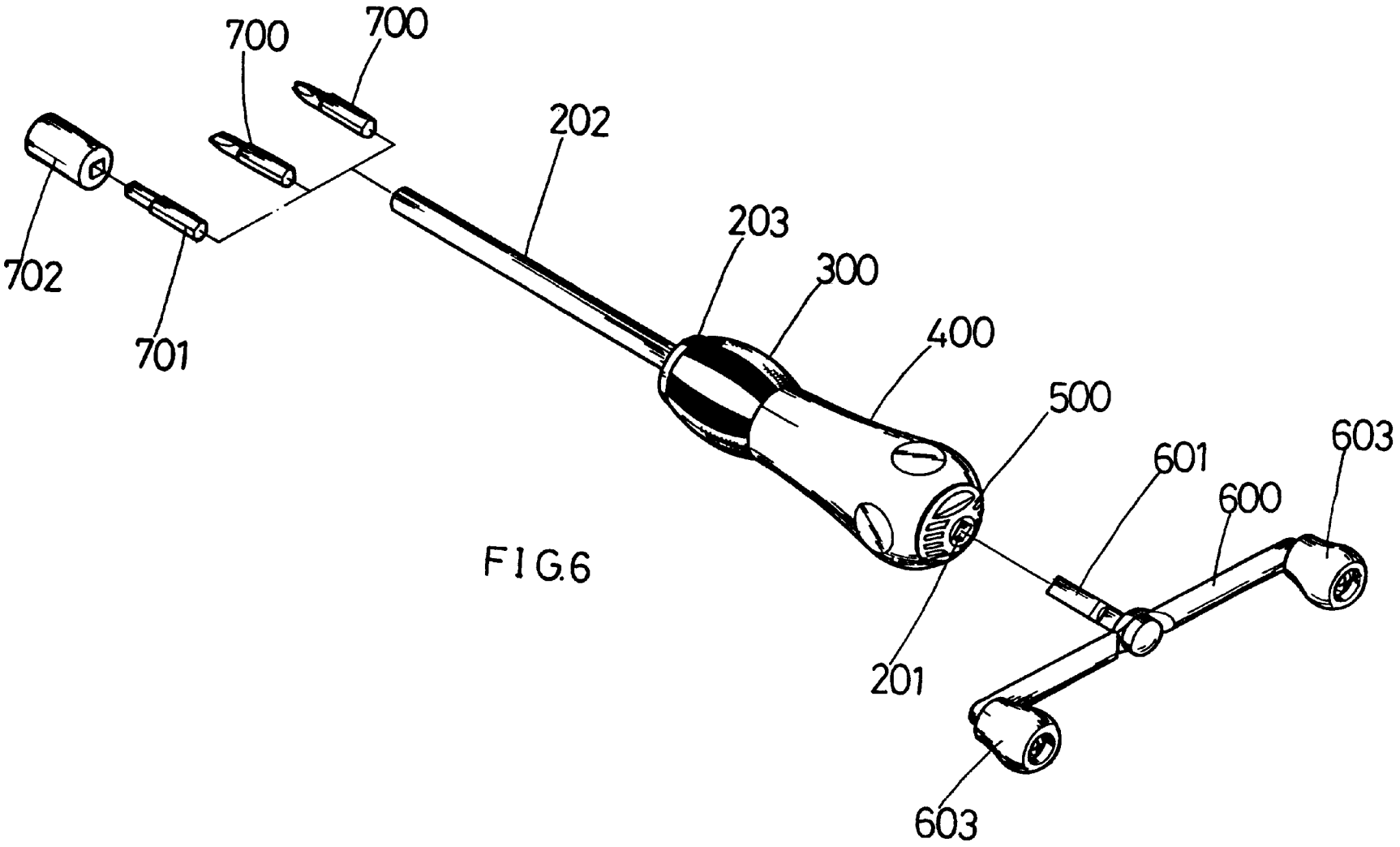
FIG. 6 is another exploded perspective view in accordance with FIG. 5 after partial assembly.

Referring to FIGS. 5 and 6, they show another preferred embodiment of the present invention. The screwdriver in accordance with the present invention includes:

- a shaft lever 200 having an axial polygon socket 201 in one end of which a application shaft 202 for screwdriver head is plugged while the other end is open, and one side of the outer circumference having an engaging edge 203 while the neighbored side being a smooth mounting sleeve 204 having a reception member 206 with an engaging shaft 205 at one side thereof, and one side of the reception member 206 having a male thread part 207;
- a turning sleeve 300 having a smooth inner hole 301 to be pivoted in the mounting sleeve 204 of the shaft lever 200 to be in a pivoted connection state;
- a handgrip 400 having a borehole 402 with engaging groove 401 for fastening it at the position of the reception member 206 of the shaft lever 200;
- a locating turning cover 500 having a female thread hole 501 for screwing with the male thread part 207 of the shaft lever 200 in order to place the turning sleeve 300 and the handgrip 400 in position;
- an U-shaped turning shaft 600 to facilitate the force application having a axial plug shaft 601 at the center thereof while a turning sleeve 603 is pivoted with a locating part 602 at two bending ends.

After the assembly of the above components, it is maintained as a conventional screwdriver in the ordinary state. In using the U-shaped turning shaft 600, the plug shaft 601 thereof is plugged into the socket 201 of the shaft lever 200. The turning sleeve 300 on the shaft lever 200 is tightly held while a rapid screwing operation is performed by means of the turning sleeve 603 on the turning shaft 600 so that a synchronic rotation of the driver head is activated.

Driver heads 700 or socket connecting shaft 701 (for connecting hexagon socket 702) in various forms and dimensions can be plugged into one end of the application shaft 202 for screwdriver head. An appropriate holding force to the plug shaft 601 of the turning shaft 600 will be created through the ball 208 and the spring ring 209 disposed at a appropriate position near the male thread part 207 of the shaft lever 200. This belongs to the prior art so that it won't be here described any more.

In short, the application shaft 202 for screwdriver head in the above-mentioned embodiment can't be adjusted in length; however, a rapid screwing operation can be achieved.

Figure 7:
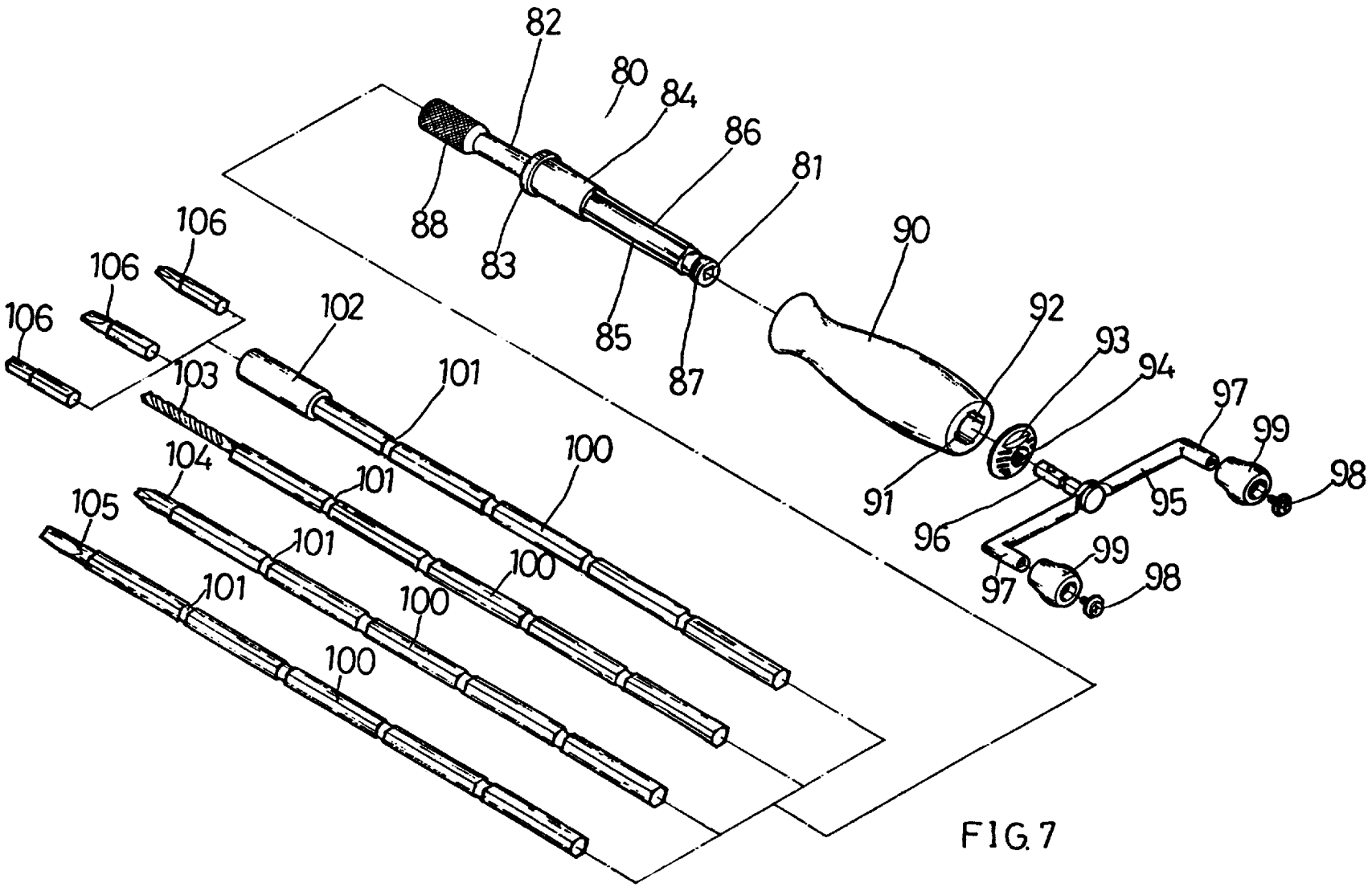
FIG. 7 is an exploded perspective view of a further preferred embodiment of the present invention.
Figure 8:
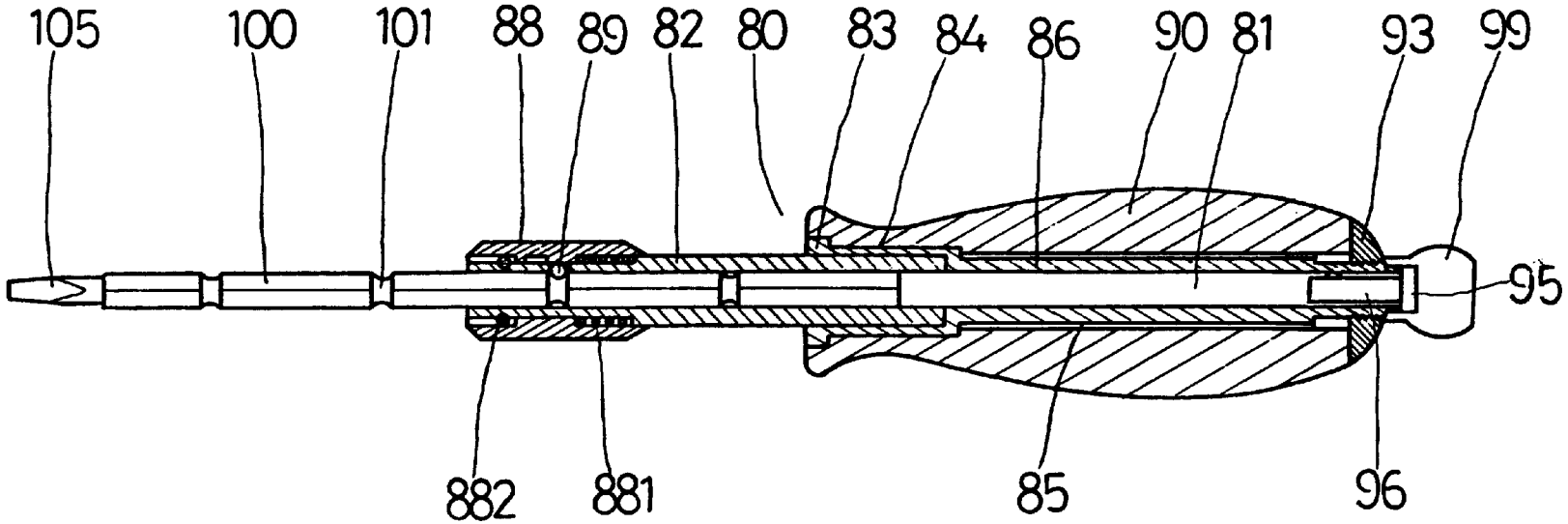
FIG. 8 is a sectional view in accordance with FIG. 7 after assembly.

Finally, referring to FIGS. 7 and 8, they show a further preferred embodiment of the present invention. The screwdriver in accordance with the present invention includes:

- a shaft lever 80 having a axial polygon socket 81 one end of which is plugged into an extension shaft 82 with a polygon inner hole so that the socket 81 and the inner hole of the extension shaft 82 are connected with each other while the other end of the shaft lever 80 is open having an engaging edge 83 on the outer circumference thereof while the neighbored side being a smooth mounting sleeve 84 having a reception member 86 with engaging shaft 85 at one side thereof, and one side of the reception member 86 having a male thread part 87;
- a handgrip 90 having a borehole 92 with engaging groove 91 fastening it at the position of the reception member 86 of the shaft lever 80;
- a locating turning cover 93 having a female thread hole 94 for screwing with the male thread part 87 of the shaft lever 80 in order to place the handgrip 90 in position;
- an U-shaped turning shaft 95 to facilitate the force application having a axial plug shaft 96 at the center thereof while a turning sleeve 99 is pivoted with a locating part 98 at two bending ends 97.

Accordingly, one end of the extension shaft 82 is fitted with an engaging turning sleeve 88 to be connected with a section-type application shaft 100 for a screwdriver head so that the application shaft 100 can be stretched inside of the socket 81 of the shaft lever and its exposing length is therefore adjustable.

The engaging turning sleeve 88 is pivoted by means of a spring 881 and a retaining ring 882 on the extension shaft 82 so that a ball 89 can be squeezed or released by moving this engaging turning sleeve 88. The ball 89 can be engaged into any ring groove 101 on the application shaft 100 for locating it in position when the ball 89 is squeezed by the engaging turning sleeve 88, and the application shaft 100 can be stretched in releasing the ball 89.

As mentioned above, the engaging turning sleeve 88 is pivoted on the extension shaft 82 so that it's turnable and, when the user uses the U-shaped turning shaft 95 to make a rapid rotation, the engaging turning sleeve 88 can be used as holding supporting point.

The main body of each application shaft for screwdriver head 100 includes a number of ring grooves 101 for engagement in position when stretching. Moreover, the application end can be made in various forms, e.g. socket shaft 102 for driver head, drill 103, Phillips screwdriver 104, slotted-type screwdriver 105, hexagon wrench (not shown) or socket wrench (not shown). Additionally, the driver head 106 in various forms can be inserted into the above-mentioned driver head socket 102 so that the present invention is practical and can be broadly used.

Certainly, the section-type application shafts 50, 100 for driver head in accordance with the present invention have been disclosed in other patent applications. However, the engagement part of the conventional application shaft 18 and steel ball 19 is disposed at the side corner 182, as shown in FIG. 1-B, so that the engaging force is not only insufficient, but also it's easier that the engaging point is broken. The engaging position of the application shaft 50,

100 and steel balls 34, 89 in accordance with the present invention is situated on any flat face a of the ring grooves 51, 101 of the application shafts 50, 100, as shown in FIG. 9 so that the engaging effect and force in accordance with the present invention is superior to the conventional. Besides, the present invention has a longer use life.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A screwdriver comprising a shaft lever with an axial polygon socket around which a turning sleeve is mounted at one end thereof in which an extension shaft with an inner hole is so plugged that said socket of said shaft lever and said inner hole of said extension shaft are connected with each other, and the other end of said shaft lever is plugged into one end of a handgrip, and said shaft lever is connected to said other end of said handgrip by means that a male thread at said other end of said shaft lever is screwed with a female thread of a locating turning cover at the other end of said handgrip, and a U-shaped turning shaft with two bending ends and a plug shaft to facilitate the force application can be plugged into said socket of said shaft lever at the end of said handgrip, the two bending ends of said U-sahped turning shaft each are pivoted with a turning sleeve respectively, and one end of said extension shaft is fitted with an engaging member to be connected with a section-type application shaft for screwdriver head so that said application shaft can be retraced to and extended from inside of said connecting inner hole of said extension shaft and said shaft lever and it exposing length is therefore adjustable.

2. A screwdriver comprising:

a shaft lever having an axial polygon socket in one end of which a application shaft for screwdriver head is plugged while the other end is open, and one side of its outer circumference having an engaging edge while a neighbored side being a smooth mounting sleeve having a reception member with an engaging shaft at one side thereof, and one side of said reception member having a male thread part;

a turning sleeve having a smooth inner hole to be pivoted in said mounting sleeve of said shaft lever to be in a pivoted connection state;

a handgrip having a borehole with engaging groove for fastening it at the position of said reception member of said shaft lever;

a locating turning cover having a female thread hole for screwing with said male thread part of said shaft lever in order to place said turning sleeve and said handgrip in position; and a U-shaped turning shaft having two bending ends to facilitate the force application and having an axial plug shaft at the center thereof while a turning sleeve is pivoted with a locating part at the two bending ends.

3. A screwdriver comprising:

a shaft lever having a axial polygon socket one end of which is plugged into an extension shaft with a polygon inner hole so that said socket and said inner hole of said extension shaft are connected with each other while the other end of said shaft lever is open having an engaging edge on its outer circumference thereof while a neighbored side being a smooth mounting sleeve having a reception member with engaging shaft at one side thereof, and one side of said reception member having a male thread part;

a handgrip having a borehole with engaging groove fastening it at the position of said reception member of said shaft lever;

a locating turning cover having a female thread hole for screwing with said male thread part of said shaft lever in order to place said handgrip in position;

a U-shaped turning shaft having two bending ends to facilitate the force application and having an axial plug shaft at the center thereof while a turning sleeve is pivoted with a locating part at the two bending ends; and an engaging turning sleeve fitted to one end of said extension shaft to be connected with a section-type application shaft for screwdriver head so that said application shaft can be retracted to and extended from inside of said socket of said shaft lever and its exposing length is therefore adjustable.

* * * * *